US011933037B2

(12) United States Patent
Coffin

(10) Patent No.: US 11,933,037 B2
(45) Date of Patent: Mar. 19, 2024

(54) SYSTEM AND METHOD FOR PREVENTING CRACKS IN STRUCTURAL CONCRETE

(71) Applicant: James Coffin, Frewsberg, NY (US)

(72) Inventor: James Coffin, Frewsberg, NY (US)

( * ) Notice: Subject to any disclaimer, the term of this patent is extended or adjusted under 35 U.S.C. 154(b) by 37 days.

(21) Appl. No.: 17/208,233

(22) Filed: Mar. 22, 2021

(65) Prior Publication Data

US 2021/0207361 A1 Jul. 8, 2021

Related U.S. Application Data

(63) Continuation-in-part of application No. 16/159,147, filed on Oct. 12, 2018, now abandoned.

(51) Int. Cl.
*E04B 1/26* (2006.01)
*E04B 1/36* (2006.01)

(52) U.S. Cl.
CPC . *E04B 1/36* (2013.01); *E04B 1/26* (2013.01)

(58) Field of Classification Search
CPC . E04F 15/08; E04F 15/12; E04F 15/14; E04F 21/24; E04F 2290/04; E04C 5/073; E04G 23/02; E04G 23/0218; E04G 23/0229; E04G 23/024; E02D 27/08; E02D 27/42; E04H 12/22
See application file for complete search history.

(56) References Cited

U.S. PATENT DOCUMENTS 5,224,313 A * 7/1993 Guillebeau, III ..... E02D 27/425 52/297
5,857,302 A * 1/1999 Lill ..... E04F 15/14 52/297
6,513,291 B2 * 2/2003 Gilsdorf ..... E02D 27/42 52/576
7,942,612 B1 * 5/2011 Willison ..... E02D 5/74 52/153
8,782,978 B1 * 7/2014 Frenette ..... E04H 12/2269 52/297
11,479,982 B2 * 10/2022 Forrester ..... E04G 13/00
2004/0045241 A1 * 3/2004 Guillebeau ..... E02D 27/42 52/378
2004/0093818 A1 * 5/2004 Simmons ..... E02D 27/42 52/297

(Continued)

FOREIGN PATENT DOCUMENTS

KR 1712458 B1 * 3/2017 ..... E04B 1/62

*Primary Examiner* — Ryan D Kwiecinski
(74) *Attorney, Agent, or Firm* — The Bilicki Law Firm, PC; James A. Cairns

(57) ABSTRACT

A system and method for preventing cracks in structural concrete associated with a building structure, the building structure having one or more wooden support columns. Each wooden support column has a base supported by a ground surface and is provided with a crack prevention member having a first, upper or top surface and a second, lower or bottom surface; an outer side wall; and an inner side wall defining a cut-out portion; the base of the wooden support beam is positioned within the cut-out portion. A concrete floor is poured on the ground surface no higher than the level of the first, upper surface of the crack prevention member, and no floor concrete or other structural concrete contacts the wooden support column. The crack prevention member may comprise various materials including rubber, plastic, resin, or other polymeric material and combinations thereof.

14 Claims, 10 Drawing Sheets

(56) References Cited

U.S. PATENT DOCUMENTS

| | | | | |
|---|---|---|---|---|
| 2007/0194205 | A1* | 8/2007 | Blackmon | E04G 13/00 249/185 |
| 2008/0035831 | A1* | 2/2008 | Rodin | E04G 13/06 249/48 |
| 2009/0178353 | A1* | 7/2009 | Reyneveld | E04H 12/2269 249/97 |
| 2009/0320396 | A1* | 12/2009 | Knudsen | E04C 3/30 52/297 |

* cited by examiner

SYSTEM AND METHOD FOR PREVENTING CRACKS IN STRUCTURAL CONCRETE

FIELD

This invention generally relates to a system and method for preventing cracks in a concrete floor where wooden support columns used to support a building layer above the concrete floor may be subject to movement.

BRIEF SUMMARY

Disclosed herein is a system and method for preventing cracks in a concrete floor associated with a building structure, the building structure having a plurality of wooden support columns for supporting the building structure. Each wooden support column has a base with at least three sides and is embedded in or rests on a ground surface underneath the building structure, with the base being unsecured to any rigid structure such that it is capable of vertical and/or horizontal movement. The system also includes one or more crack prevention members having a first, upper or top surface and a second, lower or bottom surface; an outer side wall; and an inner side wall defining a cut-out portion. The crack prevention member may be made using various materials including rubber, plastic, resin, or other polymeric material and combinations thereof.

The base of each wooden support column is positioned within the cut-out portion of the crack prevention member. The crack prevention member may have various geometric shapes including rectangular, square, triangular, or other polygon shape. The base of each column may have any shape, including square, rectangular, triangular, or other polygon shape. Each crack prevention member has a cut-out portion with a shape conforming to the shape of the base of the wooden support column to be used with the column, including rectangular, square, triangular, or other polygon shape. Thus, the cut-out portion has a shape and dimensions substantially similar to the base of each wooden support column.

A concrete floor is constructed by pouring concrete to a level such that the concrete only contacts the outer side wall of the crack prevention member. Neither the floor concrete, nor any other structural concrete, contacts the wooden support column, and the crack prevention member remains in the concrete floor after the concrete has set or cured. When a wooden support column is positioned adjacent a wall of the building structure, at least two corners of the wooden support column lie adjacent to two straight sides of the crack prevention member. Further, when a wooden support column is positioned in a corner of the building structure, at least one corner of the wooden support column lies adjacent to at least one straight side of the crack prevention member. At least one saw cut is also provided in the concrete floor. The saw cut coincides with a corner of a first crack prevention member and extends to a corner of a second crack prevention member located opposite thereto. The saw cut may extend substantially to the edge of the floor concrete where the floor concrete contacts the crack prevention member.

Also disclosed herein is a method for preventing cracks in a concrete floor associated with a building structure. The building structure is positioned atop a ground surface, and has a plurality of wooden support columns for supporting the building structure, with the base of each wooden support column being unsecured such that it is capable of vertical movement. The method includes the use of one or more crack prevention members having a first surface and a second surface, an outer side wall, and an inner side wall defining a cut-out portion.

An initial step may include placing a plurality of crack prevention members at positions on the ground surface and positioning each wooden support column through a crack prevention member via a cut-out portion associated with each crack prevention member. An initial step may also involve embedding each wooden support column into a ground surface below the building structure while leaving the base of the wooden support column unsecured such that it is capable of vertical movement. Subsequently, concrete is poured onto the ground surface to a level that matches the height of the crack prevention member. The concrete is allowed to set, at which time the concrete only contacts the outer side wall of the crack prevention member. Neither the floor concrete, nor any other structural concrete, contacts the wooden support column. Once the concrete floor has set or cured, at least one saw cut is provided in concrete floor. Each saw cut originates at a corner of a first crack prevention member and extends to a corner of a second crack prevention member located opposite thereto.

The method also includes the requirement that when a wooden support column is positioned in a corner of the building structure, at least two corners of the wooden support column lie adjacent to at least two straight sides of the crack prevention member and when a wooden support column is positioned in a corner of the building structure, at least one corner of the wooden support column lies adjacent to at least one straight side of the crack prevention member. The crack prevention member remains in the concrete floor after the concrete has set.

In another embodiment the present system is directed to preventing cracks in structural concrete associated with a building structure that has at least one wooden support column for supporting a portion of the building structure above a concrete floor. The wooden support column has a base that is supported by a ground surface underneath the building structure. The system includes at least one crack prevention member having a first surface, a second surface, an outer side wall, and an inner side wall defining a cut-out portion. The base of the wooden support column is positioned within the cut-out portion of the crack prevention member. The concrete floor is poured to a level such that the floor concrete only contacts the outer side wall of the crack prevention member and does not contact the wooden support column; in addition, no other structural concrete contacts the wooden support column. The crack prevention member may remain in the concrete floor after the concrete floor has set.

The crack prevention member may have a polygonal shape, and may include a first outer side wall, a second outer side wall, and a third outer side wall. The crack prevention member may be configured to be separable at a separation region where the first outer side wall connects to the second outer side wall. This separation may be accomplished by at least one of flexing the first outer side wall and the second outer side wall at the separation region, and cutting at least partially through the separation region.

The cut-out portion of the crack prevention member may have a polygonal shape. The base of the wooden support column may have a polygonal shape that is the same as the polygonal shape of the cut-out portion. The shape and dimensions of the cut-out portion may be substantially similar to the shape and dimensions of the base of the wooden support column.

The wooden support column and the crack prevention member may be associated such that each side of the base of the wooden support column that is not adjacent a wall of the building structure is adjacent the inner side wall of the crack prevention member.

In addition, at least one saw cut may be provided in the concrete floor, and at least one end of the saw cut may terminate adjacent a corner of the crack prevention member.

In a further embodiment of the present system for preventing cracks in structural concrete associated with a building structure, the building structure may have a plurality of wooden support columns for supporting the building structure, with each wooden support column having a base supported by a ground surface underneath the building structure. The system may include at least one, including a plurality, of crack prevention members each having a first surface, a second surface, an outer side wall, and an inner side wall defining a cut-out portion, with the base of each wooden support column being positioned within the cut-out portion of a corresponding crack prevention member. The shape and dimensions of each cut-out portion may be substantially similar to the shape and dimensions of the base of the wooden support column positioned within that cut-out portion. Again, no structural concrete contacts the wooden support columns.

The crack prevention members, and/or their cut-out portions, may have a polygonal shape. The base of each wooden support column may have a polygonal shape that is the same as the polygonal shape of the cut-out portion of the crack prevention member that the base is positioned within.

The crack prevention member and the wooden support columns are configured together such that each side of the base of each wooden support column that is not adjacent a wall of the building structure is adjacent an inner side wall of a crack prevention member.

In a yet further embodiment, the present application is directed to a method for preventing cracks in a concrete floor associated with a building structure positioned atop a ground surface, where the building structure has a plurality of wooden support columns for supporting the building structure and each wooden support column has a base and at least three sides. The method includes aligning each of a plurality of crack prevention members with the base of a corresponding wooden support column. Each crack prevention member has a first, upper or top surface and a second, lower or bottom surface, a first outer side wall, a second outer side wall, a corner formed where the first outer side wall and the second outer side wall meet, and an inner side wall defining a cut-out portion. Each cut-out portion has the same shape as the base of its corresponding wooden support column, as well as dimensions substantially similar to the dimensions of that base.

The aligning step of the present method involves causing the base of each wooden support column to extend through the cut-out portion of its corresponding crack preventing member so that each base is supported by the ground surface. Concrete is then poured, including to form a concrete floor, and the crack prevention member may remain in the concrete floor after the concrete has set; however, no structural concrete is allowed to contact the wooden support column.

The concrete floor is allowed to set, and at least one saw cut is provided in the concrete floor, with at least one end of the saw cut terminating adjacent a corner of the crack prevention member.

Each side of the base of each wooden support column that is not adjacent a wall of the building structure is adjacent the inner side wall of the crack prevention member defining the cut-out portion through which the base extends. Each base and the cut-out portion through which the base extends may have the same shape and substantially the same dimensions.

DETAILED DESCRIPTION

Figure 1:
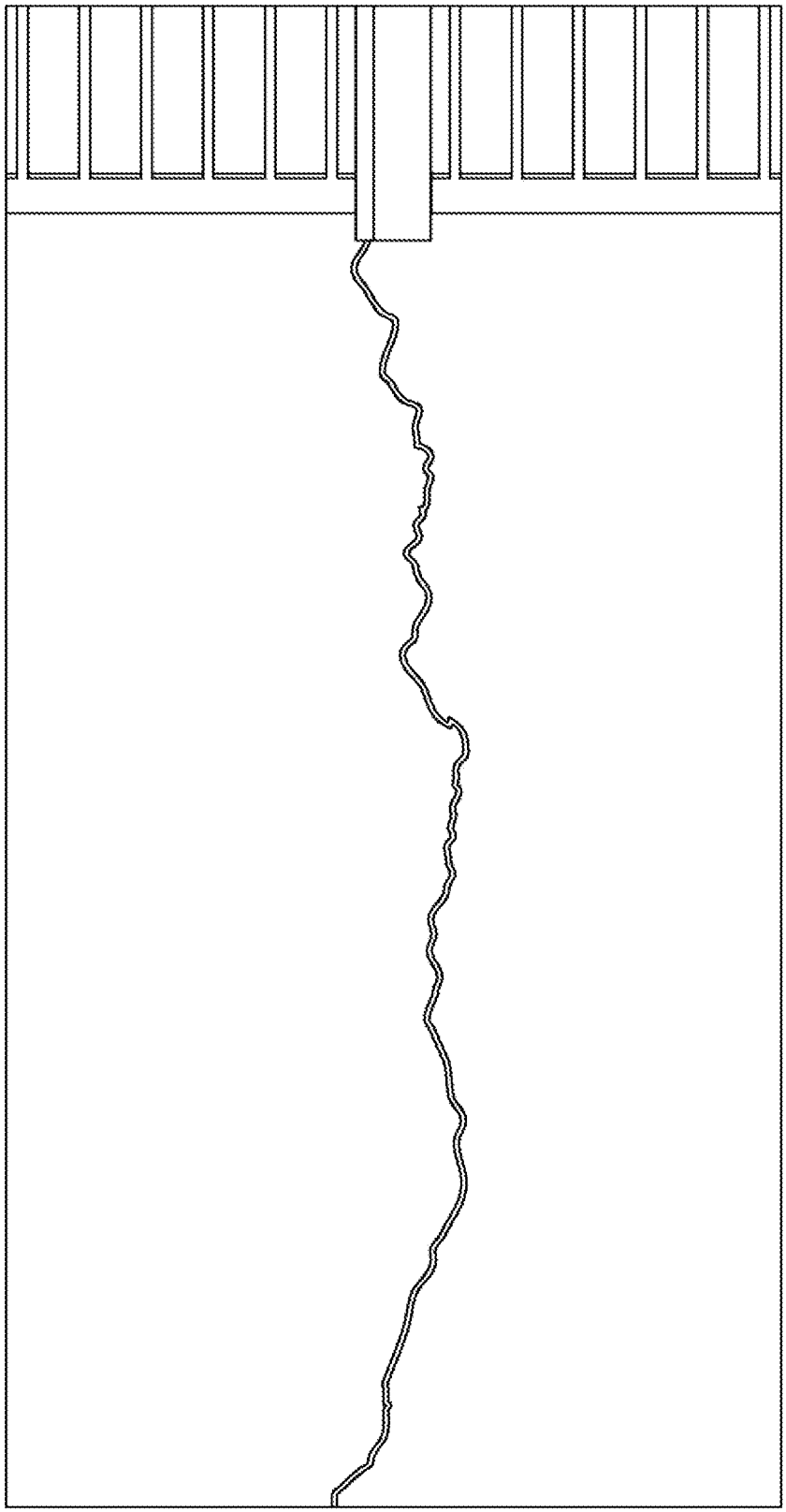
FIG. 1 shows an example of cracking that may occur in concrete floors associated with a building structure.

Referring to FIG. 1, the figure shows a concrete floor that has undergone cracking caused for example by shrinkage, frost heave, or excessive weight. Cracking in concrete is not only aesthetically unappealing, but may also compromise the structural integrity of a patio, garage, or other building structure associated with the concrete floor. In particular, where the cracks appear around a wooden support column as shown, this may weaken the wooden support column's weight-bearing capacity and lead to building code violations and/or safety concerns.

For purposes of the present description, "wooden support column" and terms similar to column such as "pole", "post", and "beam", refer to a wooden, vertical, load-bearing construction element having a base whose bottom surface is supported by the ground without being secured, attached, or affixed to another construction element intended to limit movement of the wooden support column, such as a concrete pad or base plate. The phrases "on the ground", "on the ground surface", "supported by a ground surface", and the like similarly means that the base and bottom surface of the wooden support column are not secured, attached, or affixed to another construction element intended to prevent or limit movement of the wooden support column, such as a concrete pad or base plate; it does not necessarily mean that the bottom surface of the wooden support column is in direct contact with or embedded in the ground or dirt, though such direct contact and embedding are within the present scope. References to "structural concrete" mean concrete that is deliberately added to the building structure to provide a structural function. A structural function may be to bear a load; provide a foundation, such as a concrete floor; or provide another structural feature such as concrete steps or stairs. Structural concrete does not mean concrete that is present by incidental or accidental means, such as concrete that may splash where it is not intended during pouring, or that may drip off a trowel, or be deposited by a hand or glove that has concrete on it.

In addition, statements herein to the effect that no structural concrete contacts the wooden support column mean that no concrete having a structural function in the building structure contacts the base of the wooden support column during the construction process. It is to be expected that during the process of construction some concrete may incidentally contact the wooden support column, such as by splashing or splattering, and such incidental contact of concrete with the support column does not negate the characterizations here to the effect that no structural concrete contacts the base of the wooden support column.

In construction where wooden support columns are used, the base of the wooden support column may rest on the ground and be subject to vertical movement in response to movement of the ground surface on which the base rests. Such movement of the ground may be caused, for example, by changes in ground temperature, by subsidence of the underlying ground, by upward movement of the ground such as in response to increased moisture content, and/or by changes in the load being supported by the wooden support column. In cold climates, freezing and/or thawing of the ground can cause the ground under the base of the wooden support column to rise and/or sink. For example, freezing of the ground can cause the ground contacting the bottom surface of the base of a wooden support column to move upwards, such as in a frost heave, causing the base of the wooden support column to also move upwards. Similarly, thawing or subsidence of the ground supporting the base of the wooden support column may cause the ground under the base of the wooden support column to move downwards, causing the base of the wooden support column to also move downwards. In addition, a wooden support column bearing a certain load may move upward if the weight of the load is decreased, or may move downward if the weight of the load is increased. In any situation causing vertical movement of the wooden support column, if the wooden support column is rigid contact with any concrete, directly or otherwise, and whether floor concrete or other concrete, the movement of the wooden support column may cause damage to the concrete, such as by cracking the concrete, and/or may cause damage to the wooden support column.

Figure 2:
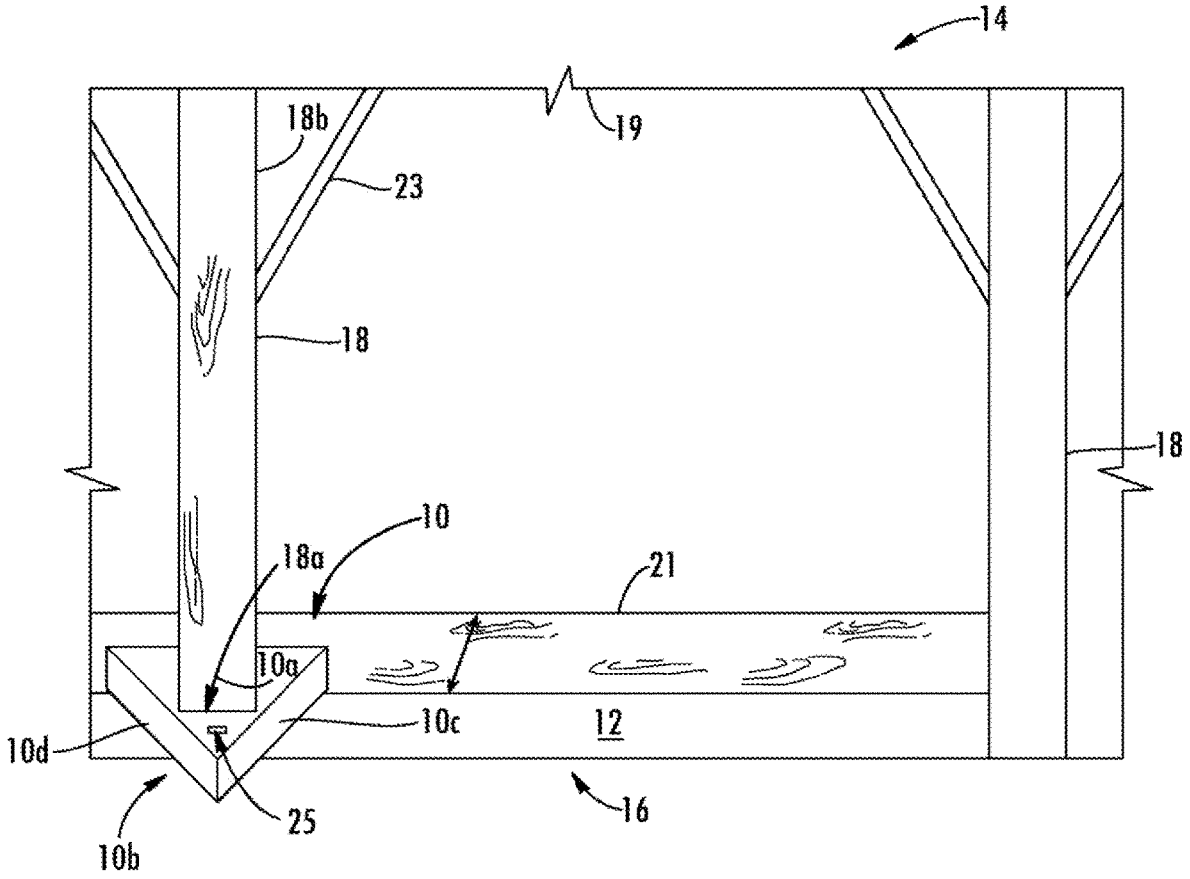
FIG. 2 shows one embodiment of a system for preventing cracks in a concrete floor of a building structure.

FIG. 2 shows a system for preventing cracks in a concrete floor 12 of a building structure 14. The system includes a plurality of wooden support columns 18, each positioned within a crack prevention member 10. Each wooden support column 18 has a base 18*a* embedded within or resting on ground surface 16. Ground surface 16 is located underneath building structure 14 and concrete floor 12, which is positioned atop ground surface 16. A top end 18*b* of wooden support column 18 is positioned adjacent an upper building layer, shown here as roof 19, of building structure 14. Each crack prevention member 10 includes a first surface 10*a*, a second surface 10*b*, at least two outer side walls 10*c*-10*d*, and at least one inner side wall 10*e*-10*g*, as well as a cut-out portion 15. The base 18*a* of each wooden support column 18 is positioned within a cut-out portion 15. Wooden support column 18 and crack prevention member 10 may be positioned adjacent an outer skirt board 21 of building structure 14, which is placed along a lower wall of building structure 14. Skirt board 21 typically runs about 2-4 inches in depth and about 12 inches in height. Two or more kicker studs 23 may extend at an angle from each wooden support column 18, for providing supplementary bracing to wooden support column 18 and building structure 14. Each wooden support column 18 may be a treated wooden post of any suitable size, including but not limited to a 6×6 inch treated post.

Crack prevention member 10 may have a rectangular, square, triangular or other polygon shape, and is typically made from rubber, plastic, resin, or other similar polymeric material as well as combinations thereof. The polymeric material of crack prevention member 10 may further include metal, graphite, ceramic, or other similar substances, which enhance the toughness and thermal properties of crack prevention member 10. Outer side walls 10*c*-10*d* and inner side walls 10*e*-10*g* of crack prevention member 10 may be about 2 to 6 inches in height. When concrete floor 12 is under construction, concrete is poured to a level such that the concrete contacts outer side walls 10*c*-10*d* of crack prevention member 10, but neither the floor concrete nor any other structural concrete contacts wooden support column 18.

Figure 3A:
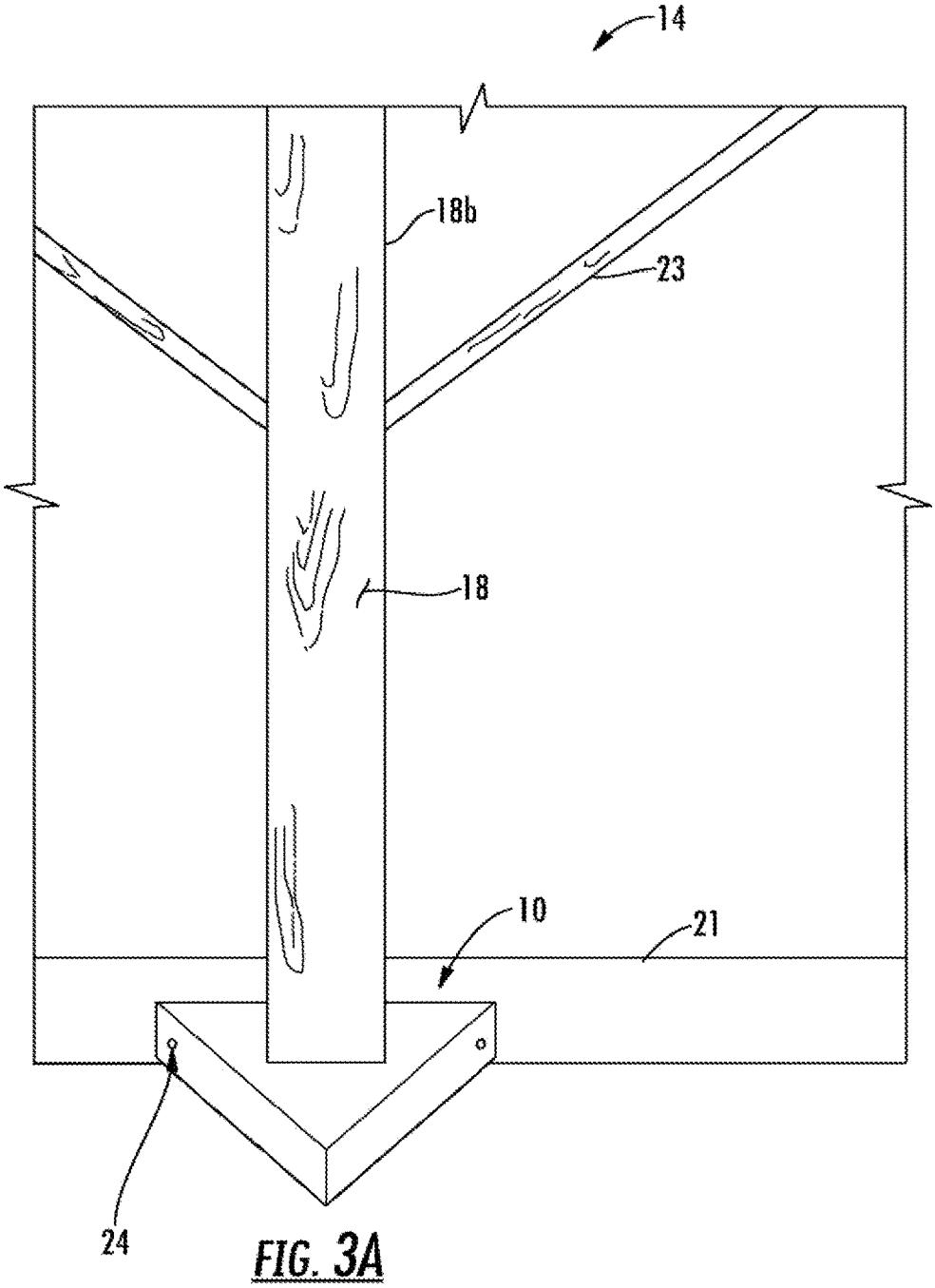
FIGS. 3A and 3B show a system for preventing cracks in a concrete floor of a building structure, including a perspective view of a crack prevention member.
Figure 3B:
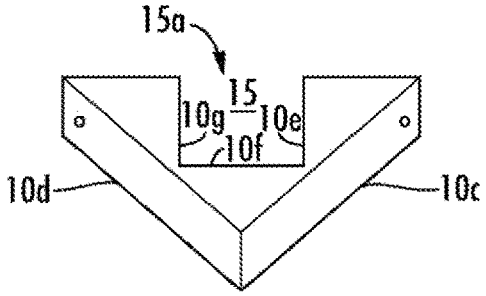

FIG. 3A shows how crack prevention member 10 may be fastened to an outer skirt board 21. In particular, outer side walls 10*c*-10*d* of crack prevention member 10 may be fastened to outer skirt board 21 via a fastening member 24. Fastening member 24 may be for example one or more bolts, pins, screws, nails, studs, or other similar fastening member known in the art. FIG. 3B is a perspective view of crack prevention member 10 showing outer side walls 10*c*-10*d*, inner side walls 10*e*-10*g*, and cut-out portion 15. In particular, FIG. 3B shows that cut-out portion 15 extends through first surface 10*a* and second surface 10*b* of crack prevention member 10 thereby exposing inner side walls 10*e*-10*g*. As shown in FIG. 3B, cut-out portion 15 has three sides coinciding with inner side walls 10*e*-10*g* and a fourth side 15*a*, which is open. This fourth open side 15*a*, facilitates the insertion of wooden support column 18 within cut-out portion 15. The base 18*a* of each wooden support column 18 may have a shape including square, rectangular, triangular, or other polygon shape. Similarly, cut-out portion 15 may have a shape and dimensions substantially similar to base 18*a* of each wooden support column 18. In the context of the relationship between the shape and dimensions of base 18*a* and cut-out portion 15, "substantially similar" means that base 18*a* substantially fills, without exceeding the dimensions of, cut-out portion 15. In other words, base 18*a* must be fully within cut-out portion 15, and should have the same shape and dimensions as cut-out portion 15 within the constraints of normal construction processes and tolerances.

Figure 4A:
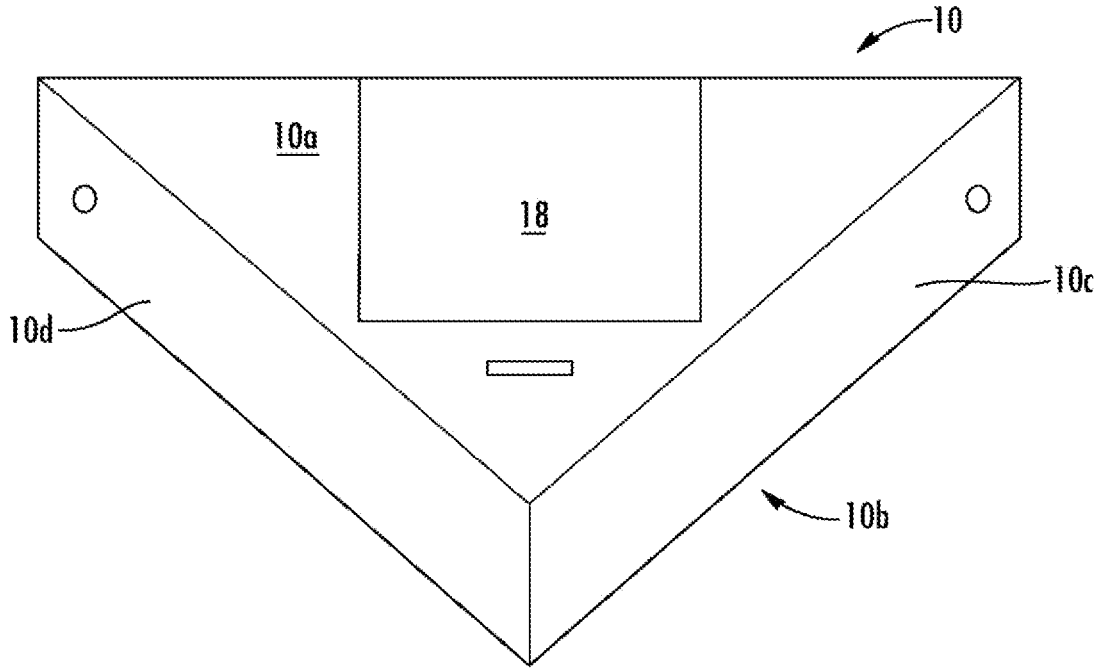
FIGS. 4A and 4B provide respective top views of two crack prevention members with two cut-out portions that vary with respect to geometric shape.
Figure 4B:
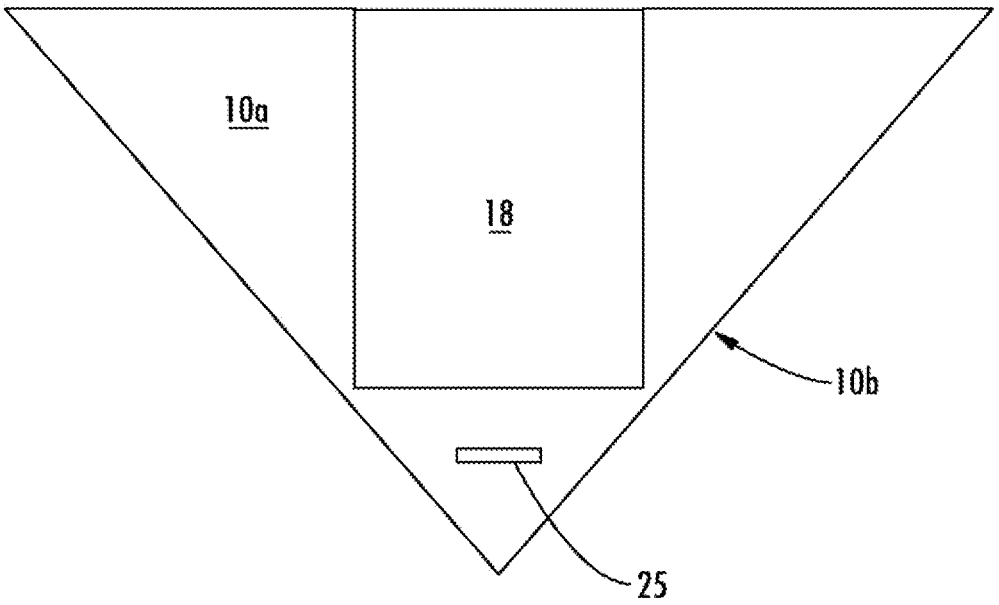

FIGS. 4A and 4B provide respective perspective and top views of crack prevention member 10. In particular, FIG. 4A shows crack prevention member 10 including outer side walls 10*c*-10*d*. Wooden support column 18 is positioned within cut-out portion 15 and may have a base 18*a* of any size and shape as long as the size and shape of base 18*a* correspond to the size and shape of the cut-out in corresponding crack prevention member 10. Here, wooden support column 18 is square-shaped measuring approximately 5-7 inches on each side thereof. In FIG. 4B, a rectangular wooden support column 18 is illustrated. As with the example shown in FIG. 4A, the sides of cut-out portion 15 may be any size as long as the dimensions of cut-out portion 15 coincides with the dimensions of wooden support column base 18*a*. FIGS. 4A and 4B also show each crack prevention member 10 may also include chalk line head holder 25. Chalk line head holder 25 allows attachment of a chalk line to each crack prevention member 10 in order to facilitate proper alignment of each crack prevention member 10 as well as a plurality of saw cuts 28 as discussed below.

Figure 5A:
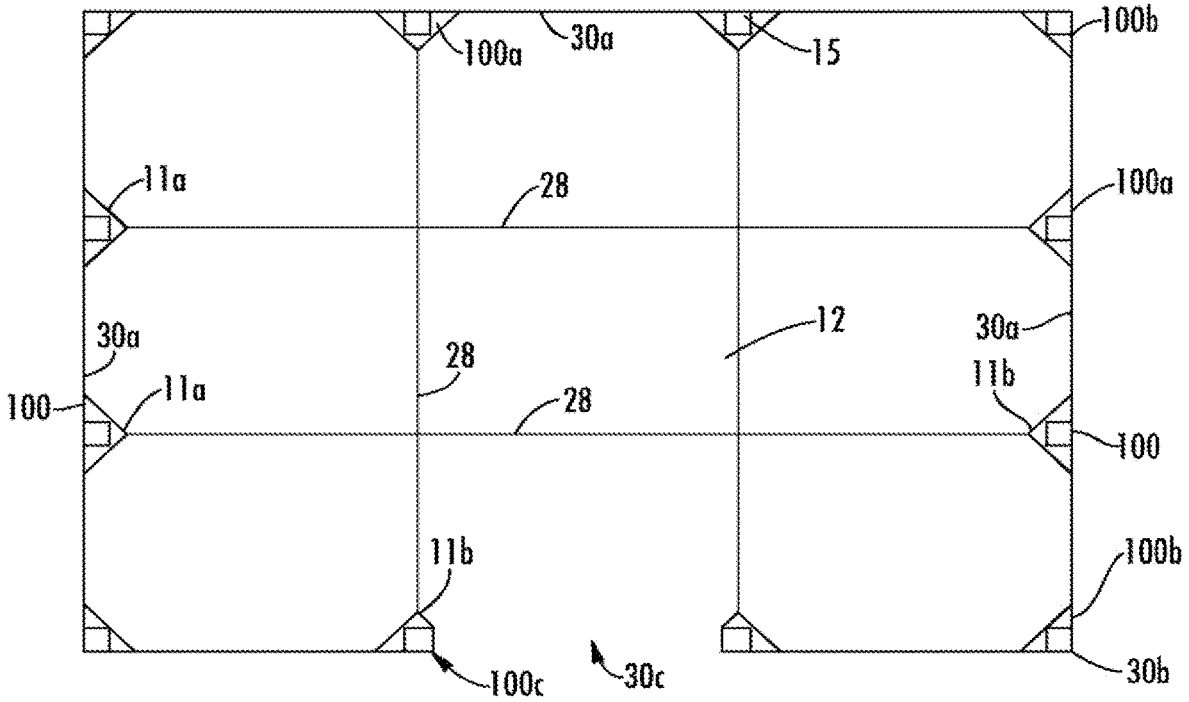
FIGS. 5A and 5B provide plan views of a concrete floor of a building structure with crack prevention members in place.
Figure 5B:
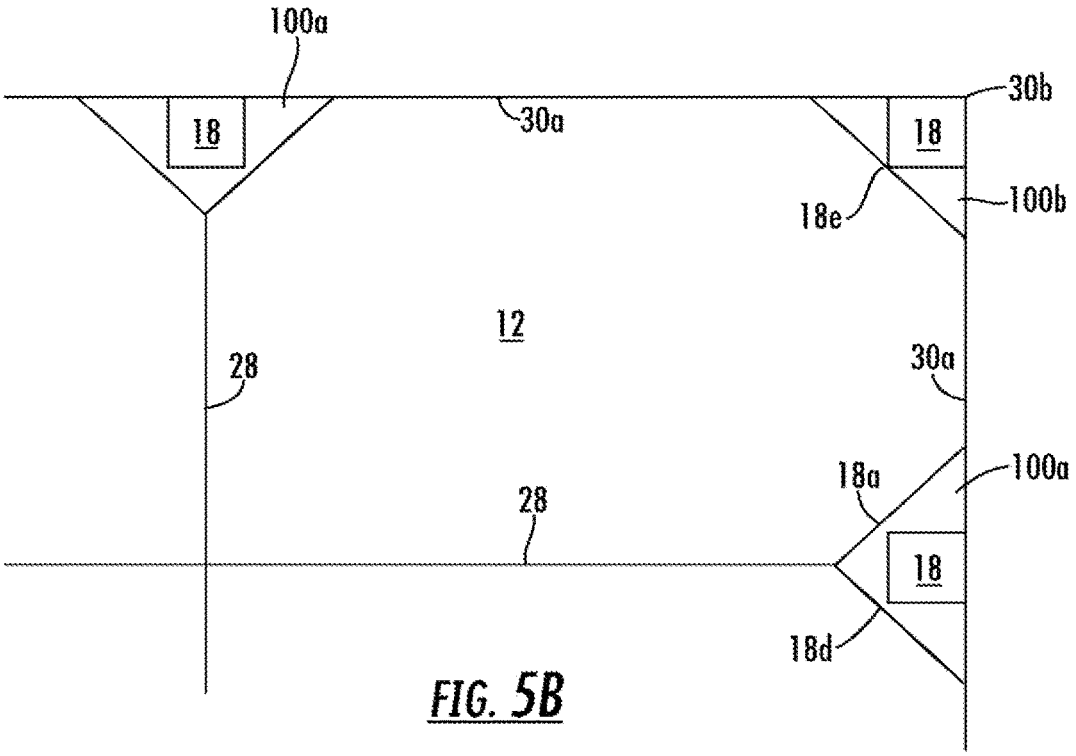

FIGS. 5A and 5B provide area views of concrete floor 12 having crack prevention members 100 distributed thereon.

Concrete floor 12 is utilized as part of a building structure 14 such as a garage, which may include a plurality of planar side walls 30. In particular, FIG. 5A shows crack prevention member 100*a* may be positioned adjacent a planar side wall 30*a*. In addition, crack prevention member 100*b* may be positioned where two planar side walls 30*a* meet forming a corner 30*b*, and crack prevention member 100*c* may be positioned near a doorway 30*c* of the building structure. Each crack prevention member 100 includes cut-out portion 15 with a wooden support column (not shown) positioned therein. Each wooden support column is embedded in ground surface 16 below concrete floor 12 in order to support the weight of the building structure 14. FIG. 5B shows that when a wooden support column 18 is positioned adjacent planar side wall 30*a* of a building structure, that at least two corners 18*c* and 18*d* of the wooden support column 18 lie adjacent two straight sides of crack prevention member 100. In contrast, when a wooden support column 18 is positioned in a corner 30*b* of building structure 14, at least one corner 18*e* thereof lies adjacent at least one straight side of crack prevention member 100. FIGS. 5A and 5B also show concrete floor 12 having a plurality of saw cuts 28. As shown in FIG. 5A, saw cuts 28 are cut into the concrete of concrete floor 12. Saw cuts 28 extend from a pointed edge 11*a* of a first crack prevention 100 to pointed edge 11*b* of a second crack prevention member 100 located directly opposite first crack prevention member 100. The purpose of saw cuts 28 is to alleviate stress and provide a further means of preventing random cracks of concrete floor 12.

Figure 6:
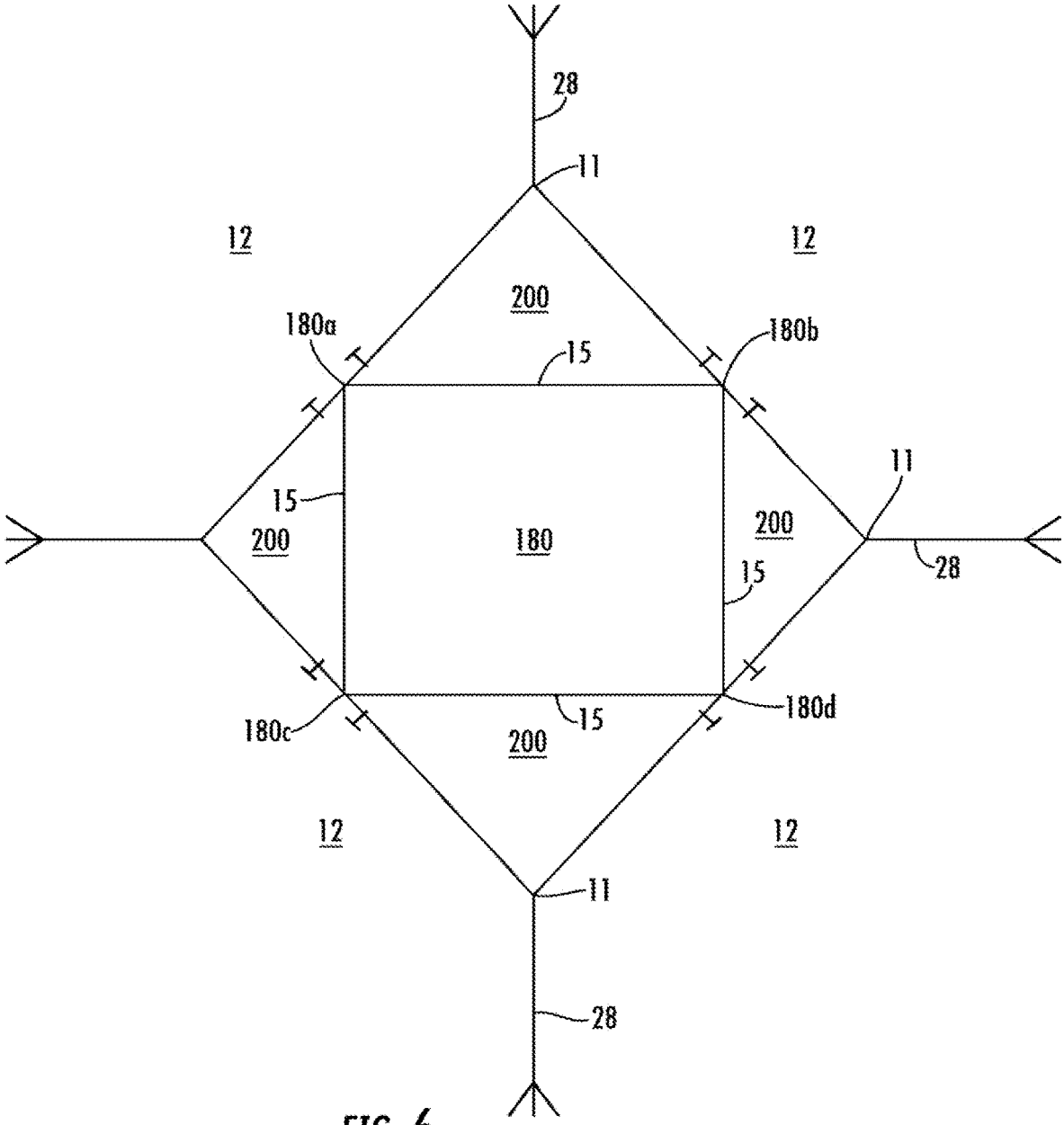
FIG. 6 shows an alternative embodiment of a crack prevention member.

FIG. 6 shows an alternative embodiment of a crack prevention member 200. In particular, crack prevention member 200 of FIG. 6 may be utilized in a central portion of a concrete floor 12. FIG. 6 contemplates three different embodiments of centrally-located crack prevention member 200. In a first embodiment, crack prevention member 200 may have the shape of two equilateral triangles, each having a rectangular cut-out portion 15 cut therein. In this embodiment, when the base of each equilateral triangle are positioned adjacently, a single square-shaped cut-out portion 15 results. In a second embodiment, four equilateral triangles are assembled so as to surround wooden support column 180. Two of the four triangles may be of one size and the other two triangles may be of a different size.

As shown in FIG. 6, wooden support column 180 is positioned such that each corner 180*a*-180*d* of wooden support column 180, lies adjacent a straight side of crack prevention member 200. In addition, as in FIGS. 5A and 5B, saw cuts 28 are cut into the concrete of concrete floor 12 after the concrete has set. Each saw cut 28 emanates from each pointed edge 11 of crack prevention member 200 in order to control cracking of concrete floor 12.

The present crack prevention system also contemplates a method for preventing cracks in a concrete floor 12 associated with a building structure 14. FIG. 2 shows concrete floor 12 of a building structure 14. Each wooden support column 18 is embedded near its base 18*a* within ground surface 16. Ground surface 16 is located underneath building structure 14 and concrete floor 12, which is positioned atop ground surface 16. A top end 18*b* of wooden support column 18 is positioned adjacent a roof 19 of building structure 14.

The first step in the method of preventing cracks in a concrete floor involves placing a plurality of crack prevention members 10 at various positions on a ground surface 16. Each crack prevention member 10 includes first, upper or top surface 10*a* and second, lower or bottom surface 10*b*; at least two outer side walls 10*c*-10*d*; and at least one inner side wall 10*e*-10*g*, as well as a cut-out portion 15. The second step entails placing the base 18*a* of each wooden support column 18 within the cut-out portion 15 of each crack prevention member 10 and into the ground surface 16 such that each wooden support column 18 is embedded into ground surface 16. Wooden support column 18 and crack prevention member 10 may be positioned adjacent an outer skirt board 21 of building structure 14, which is placed along a lower wall of building structure 14. Outer skirt board 21 typical runs about 2-4 inches in depth and about 12 inches in height. Two or more kicker studs 23 may extend at an angle from each wooden support column 18, for providing supplementary bracing to wooden support column 18 and building structure 14. Each wooden support column 18 may be a treated wooden post, such as a 6×6 inch post or any other suitable size.

A further step in the method as shown in FIG. 5A involves positioning crack prevention members 100*a* adjacent planar side walls 30*a*, positioning crack prevention members 100*b* where two planar side walls 30*a* meet forming corner 30*b*, and positioning crack prevention members 100*c* near a doorway 30*c* of building structure 14. Each type of crack prevention member 100 includes cut-out portion 15 with a wooden support column (not shown) positioned therein. Each wooden support column 18 is embedded in ground surface 16 below concrete floor 12 in order to support the weight of the building structure 14.

The next step in the method is illustrated in FIG. 5B. When wooden support column 18 is positioned adjacent planar side wall 30*a* of a building structure, wooden support column 18 is positioned such that at least two corners 18*c* and 18*d* thereof lie adjacent two straight sides of crack prevention member 100. In contrast, when a wooden support column 18 is positioned in a adjacent at least one straight side of crack prevention member 100.

Next, concrete is poured to a level such that concrete contacts the outer side walls of crack prevention member 100, but concrete does not contact wooden support columns 18. Following this step, the concrete is allowed to set. Once the concrete has cured, the concrete contacts the outer side walls of crack prevention member 100, but the concrete does not contact any part of the wooden support columns 18.

A final step in the method is shown in FIG. 5A. A plurality of saw cuts 28 are cut into the concrete of concrete floor 12 subsequent to its curing. Saw cuts 28 extend from a pointed edge 11*a* of a first crack prevention member 100 to pointed edge 11*b* of a second crack prevention member 100 located directly opposite from first crack prevention member 100. Saw cuts 28 alleviate stress and provide a further means of preventing random cracks of concrete floor 12.

Figure 7A:
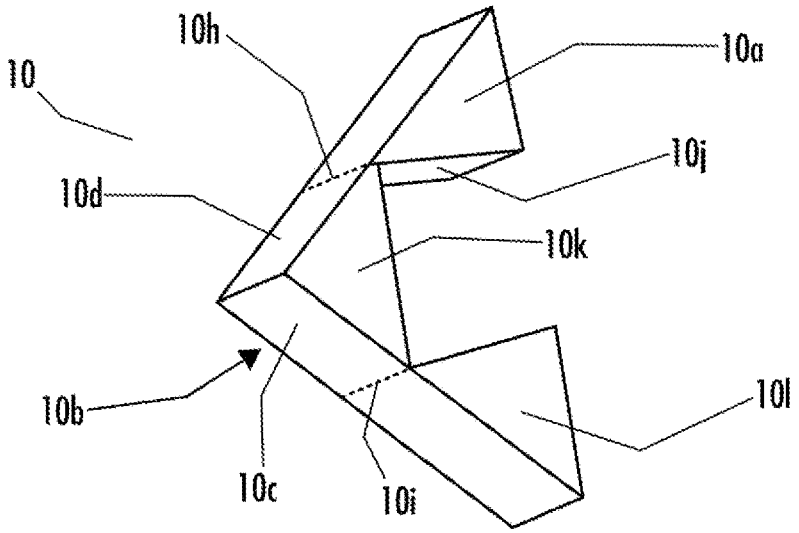
FIGS. 7A through 7C show further embodiments of a crack prevention member.

The crack prevention member may be provided with one or more separation regions that allow the device to be separated into component portions. FIG. 7A shows crack prevention member 10 including first surface 10*a*, second surface 10*b*, outer side walls 10*c* and 10*d*, first triangular crack prevention member portion 10*j*, second triangular crack prevention member portion 10*k*, and third triangular crack prevention member portion 10*l*. As shown in FIG. 7A, separation regions 10*h* and 10*i* are present at the inside corners of cut-out portion 15 of crack prevention member 10, where those inside corners are relatively adjacent to outer side walls 10*c* and 10*d*.

Because the material from which crack prevention member 10 is made is resilient and relatively thin at those separation regions, the material used to make crack prevention member 10, and/or the dimensions of crack prevention member 10, may be selected to enable separation along separation regions 10*h* and/or 10*i* such as by flexing by hand, or by cutting with a manual tool, such as a utility knife or a hand saw including but not limited to a hack saw or drywall saw, or with a power tool including but not limited to a jigsaw, reciprocating saw, or table saw. Separation of crack prevention member 10 along only separation region 10*h* will result in first crack prevention member portion 10*j* becoming a separate piece, with second crack prevention member portion 10*k*, and third crack prevention member portion 10*l* remaining joined. Further separation of crack prevention member 10 along separation region 10*i* will result in three separate pieces; first crack prevention member portion 10*j*, second crack prevention member portion 10*k*, and third crack prevention member portion 10*l*.

Figure 7B:
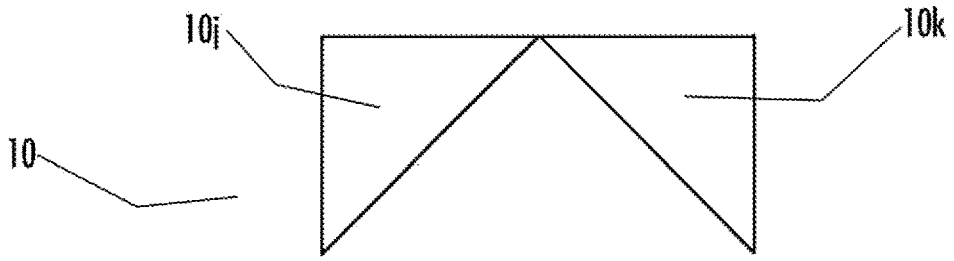

The ability to separate the present crack prevention member into portions allows those portions to be used as such, or combined in various configurations. FIG. 7B shows two such portions, first crack prevention member portion 10*j* and second crack prevention member portion 10*k*, such as might result from separating the crack prevention member of FIG. 7A along separation regions 10*h* and 10*i* to form three separate triangular portions, and using two of those portions to form a crack prevention member that could, for example, be used with a wooden support column that is positioned in a corner of a building structure. Alternatively, FIG. 7B also shows what could result from separating the crack prevention member in FIG. 7A along separation region 10*h* only, and using the larger resulting portion, having the shape of two joined triangles.

Figure 7C:
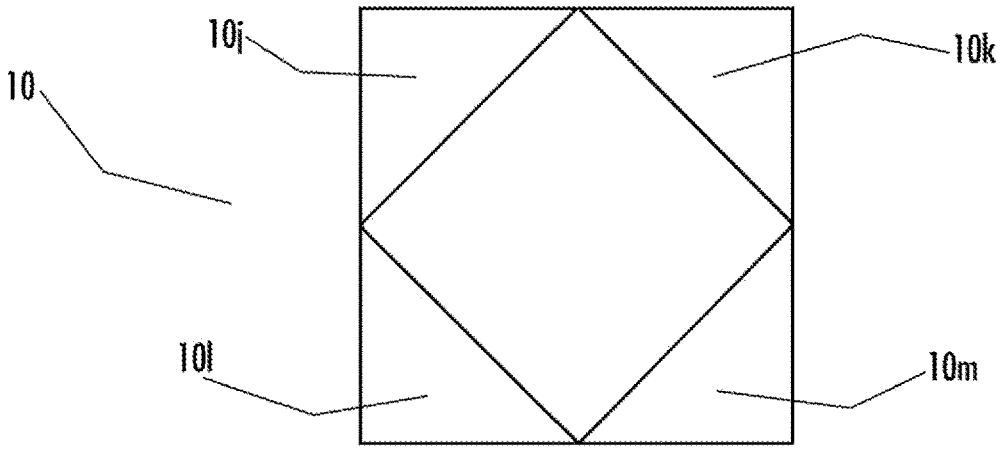

Similarly, FIG. 7C shows a configuration of the present crack prevention member having four triangular portions 10*j*-10*m*, which can be used in connection with a wooden support column that does not have any side adjacent a wall of the building structure. This configuration may be created by (a) combining two portions each consisting of two joined triangular crack prevention member portions; (b) combining four, individual triangular portions; or (c) combining a single, separated triangular crack prevention member portion with an unseparated crack prevention member (as shown for example in FIG. 4A).

Therefore, if a given crack prevention member is separated into portions during construction as herein described and not all of those portions are used with a particular wooden support column, those portions that are not used may still be used elsewhere in construction, whether by themselves, in combination with other separated portions, or with an unseparated crack prevention member. As another example, one triangular portion may be separated from a crack prevention member with the remaining portion consisting of two joined triangular portions used with a wooden support column that is positioned in a corner, such as shown in FIG. 5B at upper right, and in FIG. 8. The remaining, single triangular component may be combined with an unseparated crack prevention member for use with a wooden support column that is not adjacent a wall of the building structure, such as shown for example in FIGS. 6 and 7C. Many such combinations are possible and will be readily apparent to one of ordinary skill in the art.

It will further be appreciated that while FIGS. 7A-7C illustrate crack prevention members in which the components that may be created by separation along separation regions 10*h* and 10*i* are triangular, other shapes are possible depending on the shape of the crack prevention member to which separation is applied, including but not limited to semi-circular.

Figure 8:
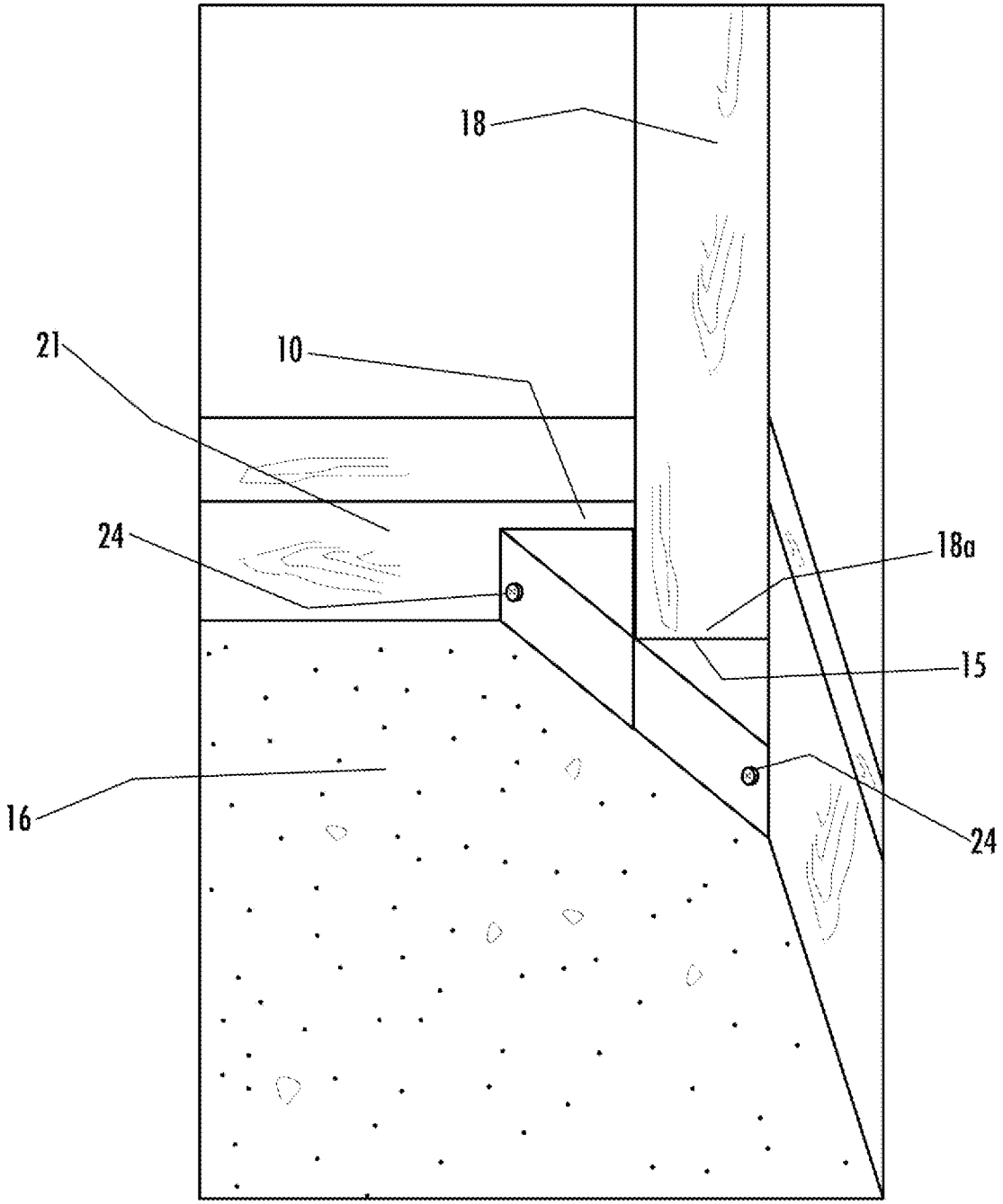
FIG. 8 shows another embodiment of a system for preventing cracks in a concrete floor of a building structure.

FIG. 8 shows an embodiment of the present system in which crack prevention member 10 may be formed as discussed in relation to FIG. 7B. Wooden support column 18 is positioned in a corner of a wall of the building structure, with base 18*a* positioned within cut-out portion 15 of crack prevention member 10. Base 18*a* is supported by ground surface 16; a concrete floor has not yet been poured. Crack prevention member 10 is attached to outer skirt board 21 by one or more fastening members 24.

Figure 9:
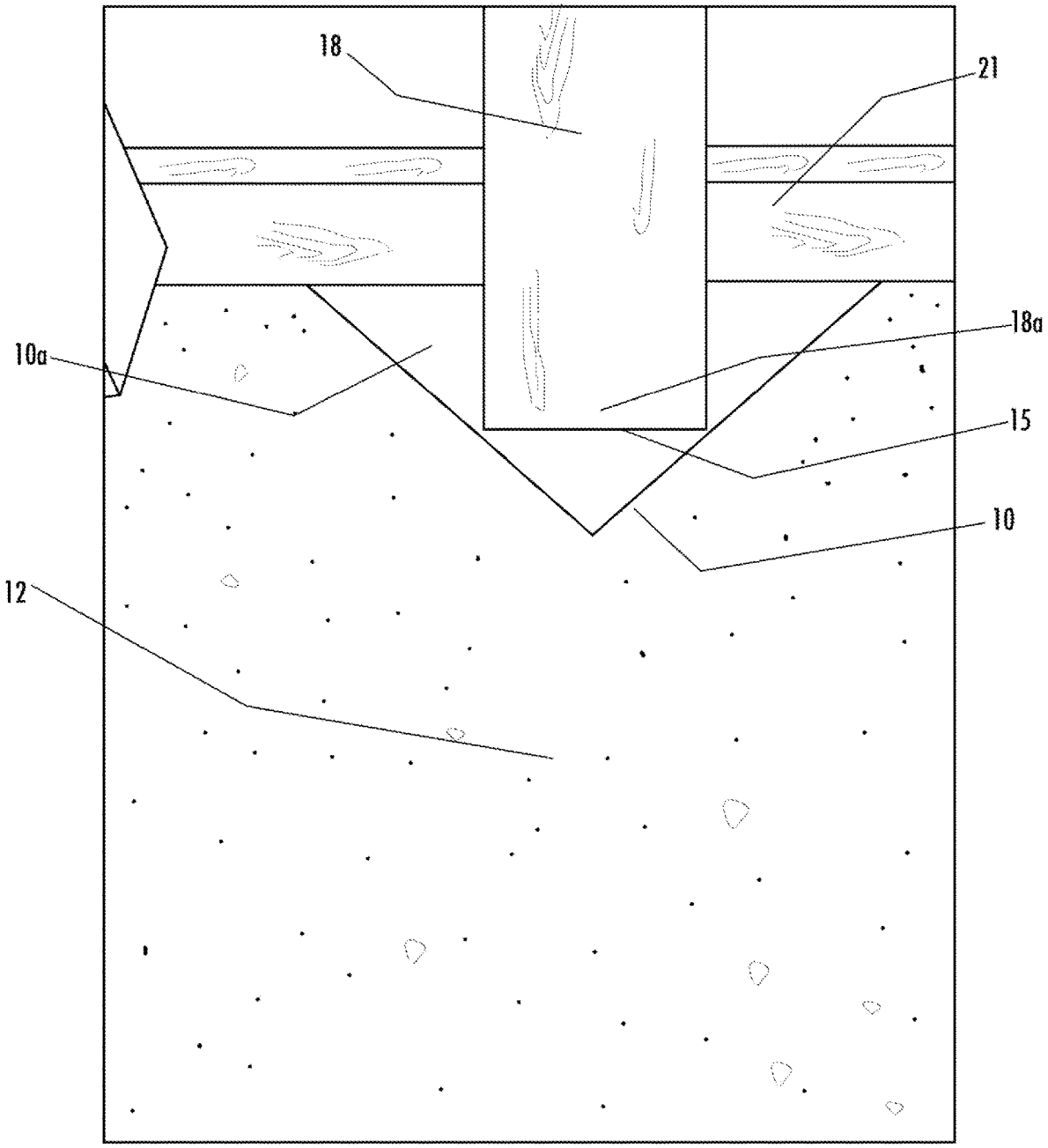
FIG. 9 shows a further embodiment of a system for preventing cracks in a concrete floor of a building structure.

FIG. 9 shows an embodiment of the present system in which wooden support column 18 is positioned with only one face adjacent a wall of the building structure, with base 18*a* within cut-out portion 15. Concrete floor 12 has been poured only up to the level of first surface 10*a* of crack prevention member 10, without being allowed to flow onto first surface 10*a* and contact wooden support column 18. Crack prevention member 10 is attached to outer skirt board 21 through fastening means which, because they are below the surface of concrete floor 12, are not visible. As may be seen, neither the concrete of concrete floor 12 nor any other structural concrete contacts wooden support column 18.

Figure 10:
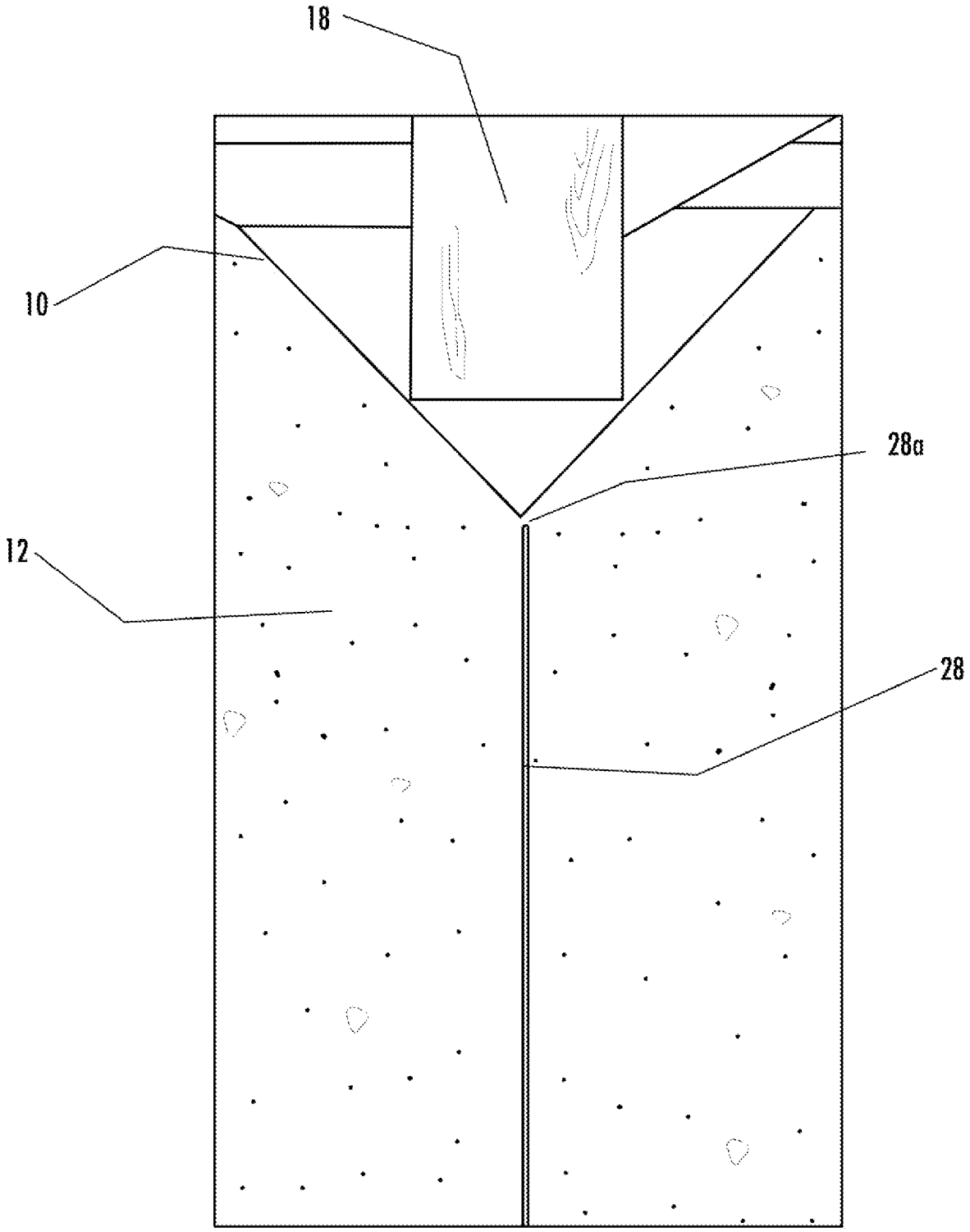
FIG. 10 shows a yet further embodiment of a system for preventing cracks in a concrete floor of a building structure.

The present system and method allows saw cuts in a concrete floor to extend to a point adjacent a corner or vertice of the present crack prevention member, as shown for example in FIGS. 5A, 5B, and 6. With particular reference to FIG. 10, it will be appreciated that in the absence of crack prevention member 10, such that concrete floor 12 extended to the base of wooden support column 18, the housing of a concrete saw or saw cart would contact wooden support column 10 before the edge of the cut reached the edge of the concrete. With crack prevention member 10 in place, however, the tip 28*a* of saw cut 28 may extend to a point adjacent the corner of crack prevention member 10.

While the present system and method have been described with reference to particular embodiments, it will be understood by those skilled in the art that various changes may be made and equivalents may be substituted for elements thereof without departing from the intended scope. Therefore, it is intended that the scope not be limited to the particular embodiments disclosed herein, but rather will include all embodiments falling within the scope and spirit of the application, including the appended claims.

The invention claimed is:

1. A system for preventing cracks in structural concrete associated with a building structure, the building structure having at least one wooden support column for supporting a portion of the building structure above a concrete floor, the wooden support column having a base supported by a ground surface underneath the building structure, the system comprising:

at least one crack prevention member having a polygonal shape and a first surface, a second surface, a first outer side wall, a second outer side wall, a third outer side wall, and an inner side wall defining a cut-out portion, further wherein said crack prevention member is configured to be separable at a separation region where said first outer side wall connects to said second outer side wall by at least one of flexing said first outer side wall and said second outer side wall at said separation region, and cutting at least partially through said separation region;

the base of the wooden support column being positioned within said cut-out portion of said crack prevention member;

wherein the concrete floor is poured to a level such that the floor concrete only contacts said outer side wall of said crack prevention member and does not contact the wooden support column;

further wherein no other structural concrete contacts the wooden support column;

and wherein said crack prevention member remains in the concrete floor after the concrete floor has set.

2. The system for preventing cracks in structural concrete associated with a building structure of claim 1, wherein said cut-out portion has a polygonal shape.

3. The system for preventing cracks in structural concrete associated with a building structure of claim 2, wherein the base of the wooden support column has a polygonal shape that is the same as the polygonal shape of said cut-out portion.

4. The system for preventing cracks in structural concrete associated with a building structure of claim 3, wherein the shape and dimensions of said cut-out portion are substantially similar to the shape and dimensions of the base of the wooden support column.

5. The system for preventing cracks in structural concrete associated with a building structure of claim 3, wherein each side of the base of the wooden support column that is not adjacent a wall of the building structure is adjacent said inner side wall of said crack prevention member.

6. The system for preventing cracks in structural concrete associated with a building structure of claim 1, wherein said crack prevention member comprises at least one of a rubber, plastic, or resin.

7. The system for preventing cracks in structural concrete associated with a building structure of claim 1, wherein at least one saw cut is provided in the concrete floor, at least one end of said saw cut terminating adjacent a corner of said crack prevention member.

8. A system for preventing cracks in structural concrete associated with a building structure, the building structure having a plurality of wooden support columns for supporting the building structure, each wooden support column having a base supported by a ground surface underneath the building structure, the system comprising:

at least one crack prevention member having a polygonal shape and a first surface, a second surface, a first outer side wall, a second outer side wall, a third outer side wall, and an inner side wall defining a cut-out portion, further wherein said crack prevention member is configured to be separable at a separation region where said first outer side wall connects to said second outer side wall by at least one of flexing said first outer side wall and said second outer side wall at said separation region, and cutting at least partially through said separation region;

the base of each wooden support column being positioned within said cut-out portion of said crack prevention member;

wherein the shape and dimensions of said cut-out portion are substantially similar to the shape and dimensions of the base of the wooden support column positioned within said cut-out portion;

further wherein no structural concrete contacts the wooden support column.

9. The system for preventing cracks in structural concrete associated with a building structure of claim 8, wherein said crack prevention member has a polygonal shape.

10. The system for preventing cracks in structural concrete associated with a building structure of claim 8, wherein said cut-out portion has a polygonal shape.

11. The system for preventing cracks in structural concrete associated with a building structure of claim 10, wherein the base of each wooden support column has a polygonal shape that is the same as the polygonal shape of the cut-out portion that the base is positioned within.

12. The system for preventing cracks in structural concrete associated with a building structure of claim 8, wherein the crack prevention member comprises at least one of a rubber, plastic, or resin.

13. The system for preventing cracks in structural concrete associated with a building structure of claim 8, wherein each side of the base of each wooden support column that is not adjacent a wall of the building structure is adjacent an inner side wall of said crack prevention member.

14. The system for preventing cracks in structural concrete associated with a building structure of claim 8, wherein at least one saw cut is provided in the concrete floor, at least one end of said saw cut terminating adjacent a corner of the crack prevention member.

* * * * *